US008636170B2

(12) United States Patent
LaFever

(10) Patent No.: US 8,636,170 B2
(45) Date of Patent: Jan. 28, 2014

(54) STRAW FOR WINE

(76) Inventor: Jenny LaFever, Ladera Ranch, CA (US)

( * ) Notice: Subject to any disclaimer, the term of this patent is extended or adjusted under 35 U.S.C. 154(b) by 0 days.

(21) Appl. No.: 13/567,604

(22) Filed: Aug. 6, 2012

(65) Prior Publication Data

US 2013/0032606 A1 Feb. 7, 2013

Related U.S. Application Data

(60) Provisional application No. 61/515,705, filed on Aug. 5, 2011.

(51) Int. Cl.

| | |
|---|---|
| ***A47G 19/22*** | (2006.01) |
| ***A45F 5/00*** | (2006.01) |
| ***B65D 83/00*** | (2006.01) |
| ***B65D 23/12*** | (2006.01) |

(52) U.S. Cl.
USPC ..... 220/710; 220/703; 220/705; 224/269; 215/388; 215/391

(58) Field of Classification Search
USPC ..... 24/11 R, 11 F; 224/269; 220/703, 705, 220/710; D7/300.2; 215/388, 391, 390; D19/56; 239/33
See application file for complete search history.

(56) References Cited

U.S. PATENT DOCUMENTS

| | | | | | |
|---|---|---|---|---|---|
| 344,567 | A | | 6/1886 | Coleman et al. | |
| 2,070,495 | A | * | 2/1937 | Strutz et al. | 215/391 |
| 2,378,660 | A | * | 6/1945 | Roux | 215/391 |
| 3,346,187 | A | * | 10/1967 | Mueller | 239/33 |
| 3,438,578 | A | * | 4/1969 | Moyer et al. | 239/33 |
| D279,993 | S | * | 8/1985 | Oka | D19/45 |
| 4,850,495 | A | * | 7/1989 | Wallace | 215/391 |
| D363,739 | S | * | 10/1995 | Petrillo | D19/48 |
| 5,671,863 | A | * | 9/1997 | Uliana | 220/710 |
| D567,004 | S | * | 4/2008 | Bottega | D7/300.2 |
| D587,312 | S | * | 2/2009 | Cetera | D19/56 |
| D596,234 | S | * | 7/2009 | Giroud | D19/56 |

* cited by examiner

*Primary Examiner* — Steven A. Reynolds
*Assistant Examiner* — Javier A Pagan
(74) *Attorney, Agent, or Firm* — Heidi Eisenhut, Esq.; Loza & Loza, LLP

(57) ABSTRACT

A wine straw comprising an elongated hollow tubular body and attaching member secured to an outer surface of the hollow tubular body is provided. The hollow tubular body comprises an upper portion and a lower portion integrally connected to the upper portion, the upper and lower portions having open ends. The attaching member comprises a clip member integrally connected to a hollow attachment member. The clip member comprises a front portion and a back portion. The front portion includes a pair of top portions; a bottom portion; an outer edge extending upwardly and outwardly, in a vertical plane, from the bottom portion towards the pair of top portions; and an inner edge extending downwardly and inwardly, in a vertical plane, from the pair of top portions to a clip center portion. The back portion includes a pair of elongated members integrally connected to the hollow attachment member.

14 Claims, 7 Drawing Sheets

STRAW FOR WINE

CLAIM OF PRIORITY UNDER 35 U.S.C. §119

The present Application for Patent claims priority to U.S. Provisional Application No. 61/515,705 entitled "STRAW FOR WINE", filed Aug. 5, 2011, and is hereby expressly incorporated by reference herein.

FIELD

One feature relates to straws and more specifically to straws for use in drinking wine.

BACKGROUND

Although excessive alcohol consumption has adverse health effects, studies have consistently demonstrated that moderate consumption of red wine has many health benefits. For example, resveratrol, a compound in red wine, has been shown to increase lifespan in animal studies, protect against Alzheimer's disease and dementia, reduce the risk of heart and cardiovascular disease, lower LDL cholesterol, and reduce the risks of some cancers. Additionally, resveratrol has been shown to have anti-inflammatory properties, which have been shown to help overall physical health since many diseases and ailments can be attributed to inflammation.

Despite these benefits, there are still some negative aspects to the consumption of red wine, including but not limited to, wine-moustaches (i.e. a stain of wine on the upper lip) and temporary and/or permanent stained teeth (e.g. purple teeth). These negative side effects, however, can be prevented. Dentists and dental professionals recommend that one way to enjoy the benefits of red wine without experiencing the negative aspects is to drink the wine through a straw. Although drinking straws exist, they are not designed for wine and often alter the taste and/or experience of drinking the wine. Existing straws are large (i.e. not discreet), have too wide of an inner diameter, are made from flimsy, porous plastic, come into direct contact with any sediment in the glass, and are expensive to manufacture.

In view of the foregoing, what is needed is a straw for wine that allows wine drinkers to consume wine without obtaining a wine-moustache, stained teeth, and stained lips, and also to keep lipstick and lip gloss on a drinker's lips and not on the wine glass. More specifically, a wine straw that is easy to manufacture, that is discreet, avoids the consumption of sediment at the bottom of the wine glass, and allows the drinker to consume the wine from the top surface of the liquid, where the wine has been exposed to oxygen and has been aerated, is needed.

SUMMARY

One feature provides a drinking straw for wine comprising a generally elongated hollow tubular body and an attaching member secured to an outer surface of the elongated hollow tubular body. The elongated hollow tubular body comprises an upper portion, having an upper open end for insertion into the mouth of a user to induce suction in the elongated hollow tubular body; and a lower portion integrally connected to the upper portion, the lower portion having a lower open end. The attaching member comprises a clip member; and a hollow attachment member integrally connected to the clip member.

The elongated hollow tubular body may further comprise a center portion integrally connecting the upper portion to the lower portion where the center portion is compressible and expandable for adjusting the length of the elongated hollow tubular body and for adjusting an angle of the upper portion relative to the lower portion.

The hollow attachment member may be circular and have an inner diameter slightly larger than an outer diameter of the elongated tubular body allowing the hollow attachment member to be slipped over the elongated tubular body.

The clip member may comprise a front portion and a back portion. The front portion may comprise a pair of top portions; a bottom portion; an outer edge extending upwardly and outwardly, in a vertical plane, from the bottom portion towards the pair of top portions forming a generally V-shaped configuration; and an inner edge extending downwardly and inwardly, in a vertical plane, from the pair of top portions to a clip center portion, the clip center portion located approximately half way down the clip member. The back portion may comprise a pair of elongated members integrally connected to the pair of top portions at a first end and the hollow attachment member at a second end. The pair of elongated members may be located on opposite sides of the elongated hollow tubular body.

The outer edge of the front portion may extend outwardly, in a horizontal plane, from the bottom portion to a mid-point of the outer edge and then extend inwardly, in the horizontal plane, to the pair of top portions.

The inner edge of the front portion may extend outwardly, in a horizontal plane, from the clip center portion to a mid-point of the inner edge and then extend inwardly, in the horizontal plane, to the pair of top portions.

The hollow attachment member may comprise a back section having a back vertical length; a front section having a front vertical length, the back vertical length longer than the front vertical length; an upper end section extending downwardly from a top of the back section to a top of the front section; and a lower end section extending upwardly from a bottom of the back section to a bottom the front section. The back section of the hollow attachment member may include a slit extending the back vertical length.

The attaching member may be secured to a rim of a glass allowing the elongated hollow tubular body to extend downwardly into the glass and the lower open end of the elongated hollow tubular body to terminate above a top surface of liquid within the glass.

According to one feature, the upper open end and the lower open end have an angled surface.

According to one feature the upper open end and the lower open end have a flat surface.

According to one feature the front portion of the clip member includes a receptacle adapted for receiving one of a plurality of identification members. The plurality of identification members may differ in color or design allowing the user (or drinker) to identify a particular glass. The plurality of identification member may also have an outer surface made of a chalkboard type material allowing the user to personalize an identification member.

BRIEF DESCRIPTION OF THE DRAWINGS

The features, nature, and advantages of the present embodiments may become more apparent from the detailed description set forth below when taken in conjunction with the drawings in which like reference characters identify correspondingly throughout.

DETAILED DESCRIPTION

The following detailed description is of the best currently contemplated modes of carrying out the invention. The description is not to be taken in a limiting sense, but is made merely for the purpose of illustrating the general principles of the invention.

Furthermore, in the following description, specific details are given to provide a thorough understanding of the embodiments. However, it will be understood by one of ordinary skill in the art that the embodiments may be practiced without these specific details.

While the present invention is described primarily with respect to wine, the present invention may be applied and adapted to consumption of various beverages, including but not limited to, grape juice, tomato juice, coffee and tea.

In the following description, certain terminology is used to describe certain features of one or more embodiments of the invention. The term "glass" refers to any type of receptacle or container for holding a consumable liquid. The term "hollow attachment member" refers to a hollow member of any shape, including but not limited to, circular, oval, square, triangular, rectangular or elliptical, for receiving a tubular member having the same or similar shape.

It is known that, to fully get the benefits of resveratrol in wines, it is recommended to sip slowly when drinking wines. Due to inactivation in the gut and liver, most of the resveratrol in imbibed red wine does not reach the blood circulation. However, when sipped slowly, absorption via the mucous membranes in the mouth can result in up to around 100 times the blood levels of resveratrol. One way to ensure that wine is sipped slowly is with the use of a wine straw, which has a much smaller inner diameter than the average drinking straw, so that the flow of wine into your mouth is just like sipping it from a glass.

Features of the present invention include, but are not limited to, (1) allowing a person (or drinker) to be discreet when sipping the wine so as to appear like any regular wine drinker by allowing the glass to tilt when sipping, and not having to hold onto the straw, i.e. holding the glass or the stem of the glass; (2) avoid consuming sediment left by the wine at the bottom of the glass; (3) allowing a person to be able to drink from the top portion of the wine's surface, where the wine has been exposed to oxygen and has been aerated; (4) allowing the wine to bypass the teeth and lips of a drinker preventing staining of the teeth and lips; and (5) an upper portion of the straw is shorter than a typical drinking straw so that the straw extends out from the glass only a short distance keeping the nose of the drinker close to the glass allowing the drinker to enjoy/experience the bouquet/aroma of the wine.

Figure 1:
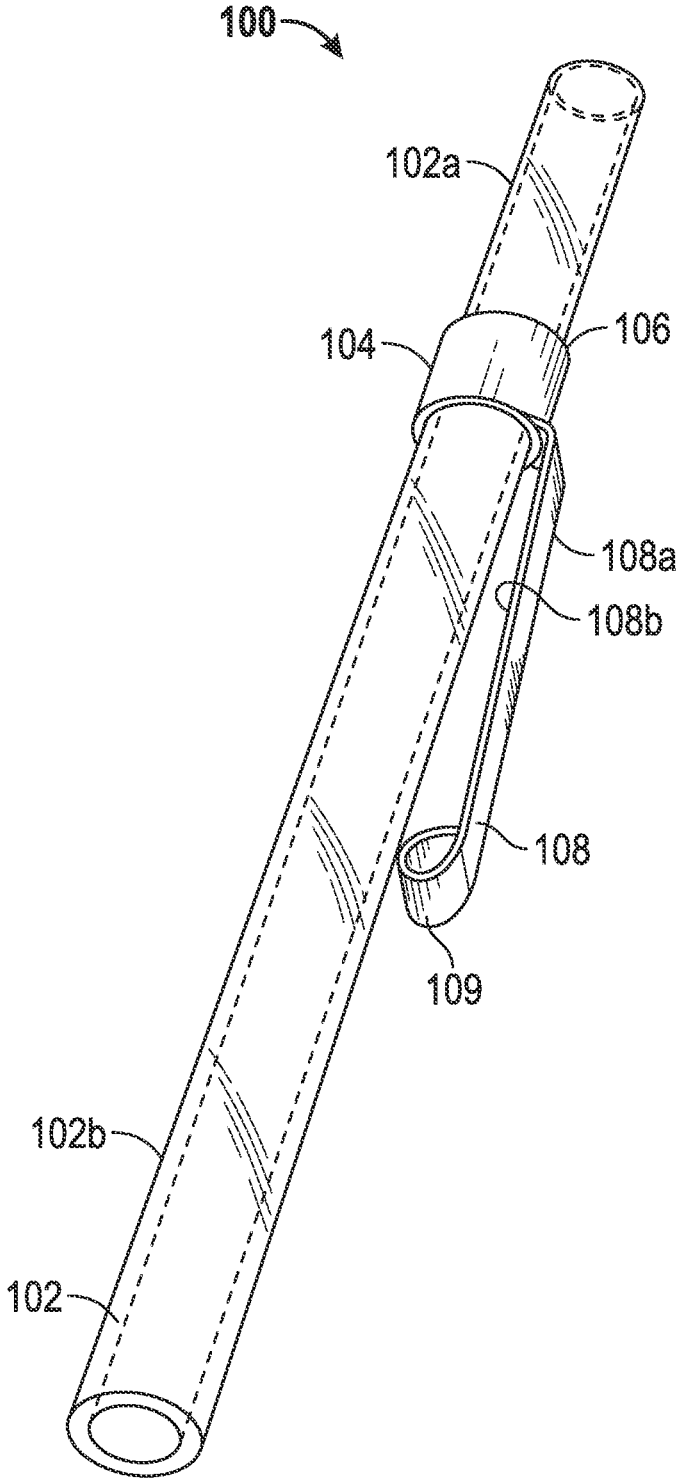
FIG. 1 illustrates a drinking straw having an attaching member according to one embodiment of the present invention.

FIG. 1 illustrates a drinking straw according to one embodiment of the present invention. The straw 100 may include a generally elongated hollow tubular body 102 and an attaching member 104 designed to attach to the rim or edge of a glass or other container allowing the straw to be secured the glass. The generally elongated tubular body 102 may comprise an upper portion 102*a*, having an upper open end for insertion into the mouth of a user to induce suction in the tubular body, integrally connected to a lower portion 102*b*, having a lower open end immersible in a liquid in a glass. In accordance with one embodiment, the upper portion may be angled slightly from the lower portion.

The attaching member 104 may be adapted to be secured to an outer surface of the tubular body. In accordance with one embodiment, the attaching member 104 may include a securing ring 106 and an elongated member 108 integrally connected to and outwardly extending downward from the securing ring 106. The elongated member 108 may have an outer surface 108*a* and an inner surface 108*b* and a protrusion 109 extending outwardly from the inner surface 108*b* toward the elongated hollow tubular body 102 when the attaching member 104 is secured to the elongated hollow tubular body 102.

The securing ring 106 of the attaching member 104 may have an inner diameter slightly larger than an outer diameter of the tubular body 102 allowing the securing ring 106 to be slipped over and permanently affixed to the tubular body 102. The attaching member 104 may be located approximately in the upper third to middle of the elongated hollow tubular body 102.

In yet another embodiment, the elongated hollow tubular member 102 and the attaching member 104 may be one molded piece.

In yet another embodiment, the securing ring 106 may be slipped over and frictionally, but releasably, engaged with the tubular body 102.

In one embodiment, the elongated member 108 may be generally in the form of a relatively narrow, straight, sticklike member that is generally parallel (although slightly outwardly extending downward) to the elongated hollow tubular body 102. In one embodiment, the attaching member 104 may be integrally formed with the elongated hollow tubular body 102.

Figure 3:
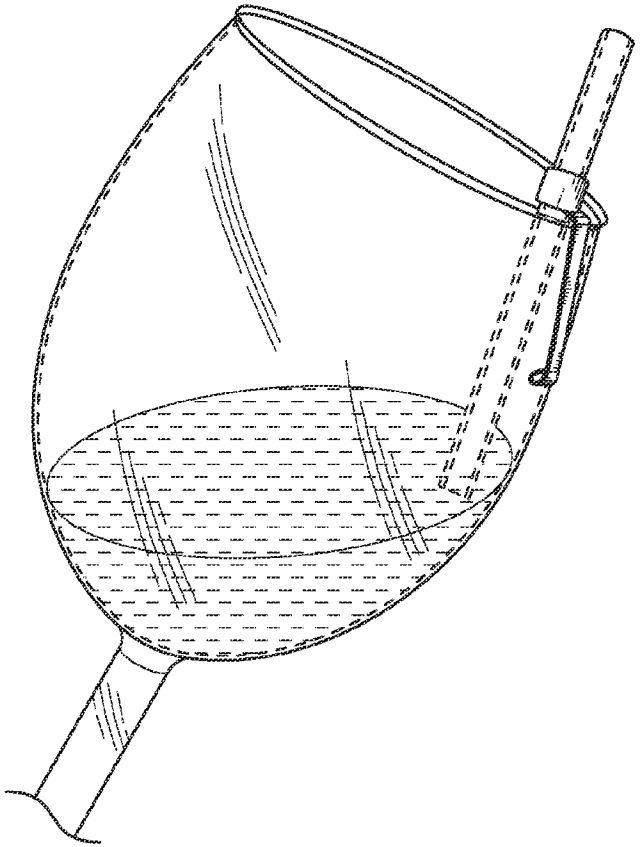
FIG. 3 illustrates the glass of FIG. 2 in a tipped position.
Figure 2:
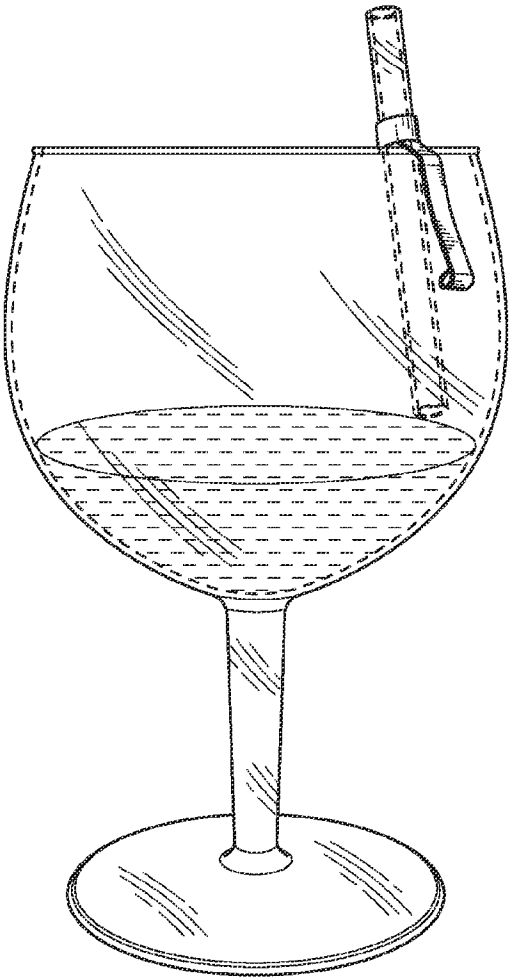
FIG. 2 illustrates the drinking straw of FIG. 1 secured to a glass, containing a liquid, located in an upright position.

When in use, the attaching member 104 of the elongated hollow tubular body 102 of the straw 100 may be slipped over the rim of a glass such that the elongated hollow tubular body 102 extends downwardly into the glass and the side of the glass is located between the elongated tubular body 102 and the inner surface 108*a* of the elongated member 108 of the attaching member 104, securing the straw 100 to the glass. (See FIG. 2) The attaching member 104 may prevent the elongated hollow tubular body 102 of the straw 100 from moving and/or shifting when secured to the edge/rim. As the straw 100 is secured in place, the straw 100 may be ensured of not coming into contact with the bottom of the glass and as a result the sediment that settles at that bottom preventing the drinker from accidentally consuming the sediment. In other words, the attaching member 104 may hold the straw 100 firmly against the inside of the glass and the lower open end of the straw touching the inside portion of the glass's sidewall. The elongated hollow tubular body 102 may have a length which is less than the length of the side wall of the glass so that the elongated hollow tubular body 102 does not contact the inner bottom surface of the glass. As the glass is tipped, the lower open end of the lower portion 102*b* may be immersed in the liquid in the glass. (See FIG. 3)

Figures 4A, 4B:
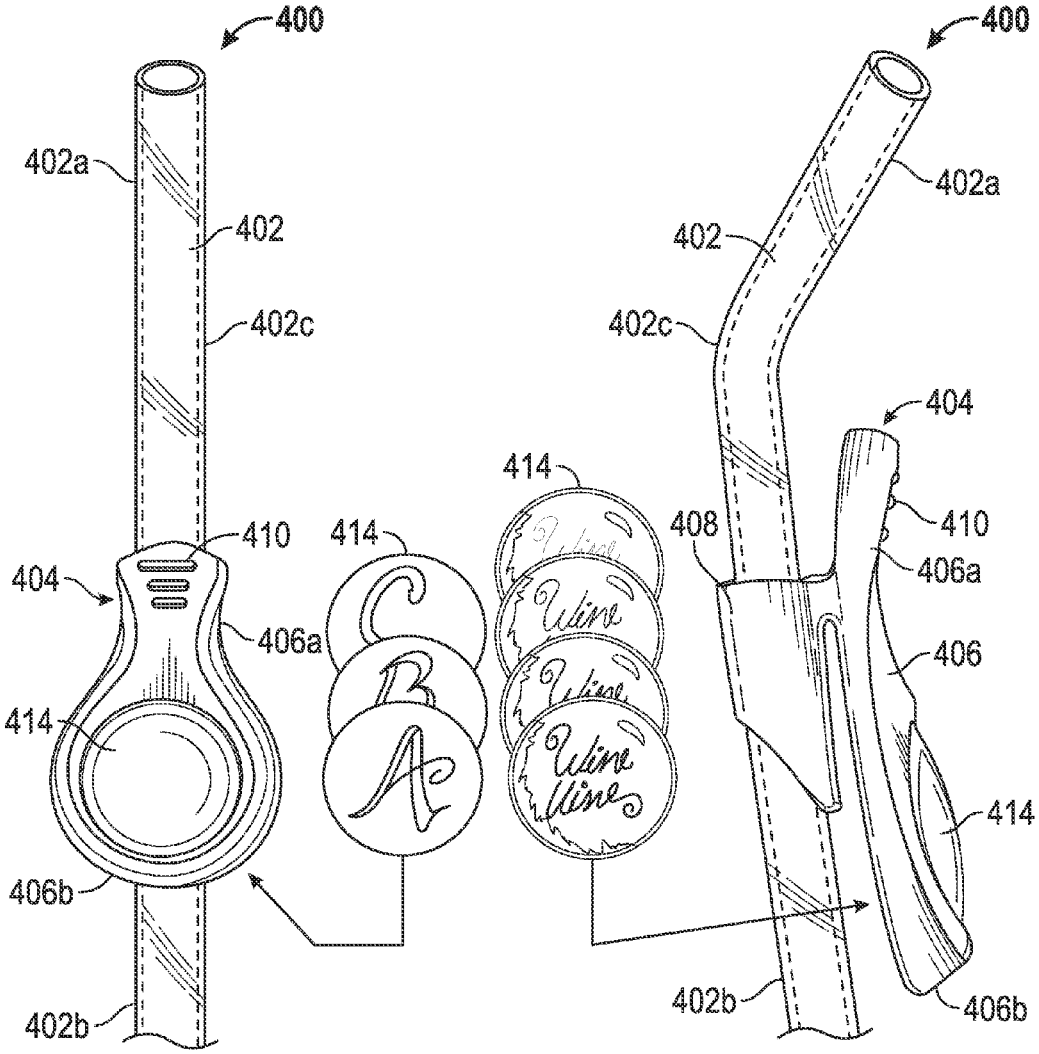
FIG. 4 (comprising FIGS. 4A and 4B) illustrates a drinking straw having an attaching member according to one embodiment of the present invention.

FIG. 4 (comprising FIGS. 4A and 4B) illustrates a drinking straw having an attaching member according to one embodiment of the present invention. The straw 400 may include a generally elongated hollow tubular body 402 and an attaching member 404 designed to attach to the rim or edge of a glass or other container allowing the straw to be secured to the glass. The generally elongated tubular body 402 may comprise an upper portion 402*a*, having an upper open end for insertion into the mouth of a user to induce suction in the tubular body, integrally connected to a lower portion 402*b*, having a lower open end immersible in a liquid in a glass. The upper portion 402*a* may be integrally connected to the lower portion 402*b* via a center portion 402*c*. The center portion 402*c* may be curved for allowing the upper portion 402*a* to be angled slightly outward from the bottom portion 402*b* towards the user. In one embodiment, the center portion 402*c* may be a compressible and expandable section allowing the length of the elongated hollow tubular body 402 to be adjusted to the size of the glass and/or the volume or amount of wine within the glass. Additionally, the compressible and expandable center portion 402*c* may allow the user to adjust the angle of the upper portion 402*a* relative to the bottom portion 402*b*.

In accordance with one embodiment, the attaching member 404 may include a clip 406 integrally or slideably connected to a hollow attachment member 408. The hollow attachment member 408 may have an inner diameter slightly larger than an outer diameter of the tubular body 402 allowing the hollow attachment member 408 to be slipped over and permanently or releasably affixed to the elongated tubular body 402. When in use, the elongated tubular body 402 of the straw 400 may be placed in a glass such that the elongated hollow tubular body 402 extends downwardly into the glass and the clip 406 of the attaching member 404 is secured or clipped to the rim of the glass securing the straw 400 to the glass.

The clip 406 may include an upper portion 406*a* and a lower portion 406*b*. The upper portion 406*a* may include a plurality of ridges 410 allowing the drinker to easily grip the clip 404. In one embodiment, the drinker may press forward on the plurality of ridges 410 increasing the distance between the clip 406 and the hollow attachment member to adjust for varying thickness of glasses.

The lower portion 406*b* may have a generally circular shape and include a receptacle 414 adapted for receiving an identification member 414, such as a charm or other identifier. The identification member 414 may be releasably received into the receptacle allowing the identification member 414 to be replaced. For example, a plurality of identification members having different colors and styles (e.g. different logos) may be located on an outer surface of the identification members to assist drinkers in identifying their glass to ensure that everyone is drinking from their own glass. That is, each drinker may have a different identification member 414 for distinguishing his or her own glass.

Alternatively, the outer surface of the identification members 414 may be made of, or coated with, a chalkboard type material allowing each drinker to personalize his or her own identification member 414. By using a chalkboard or coating with a chalkboard type material, the personalization of the outer surface may be erased and the identification markers can be re-used.

Figure 5:
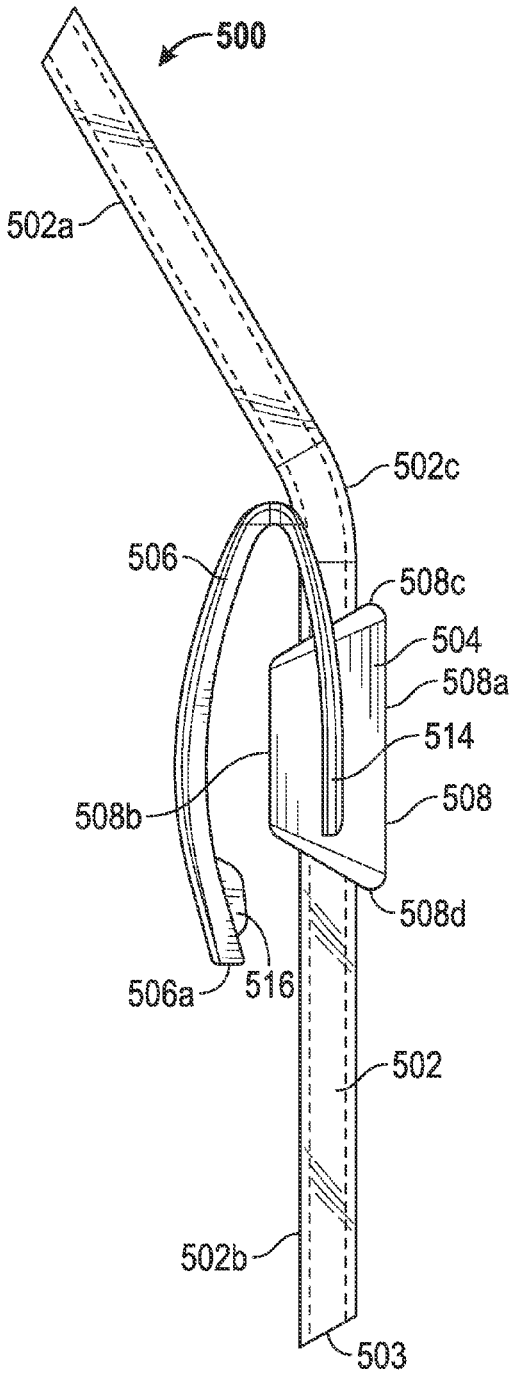
FIG. 5 illustrates a left side plan view of a drinking straw having an attaching member according to one embodiment of the present invention.
Figure 6:
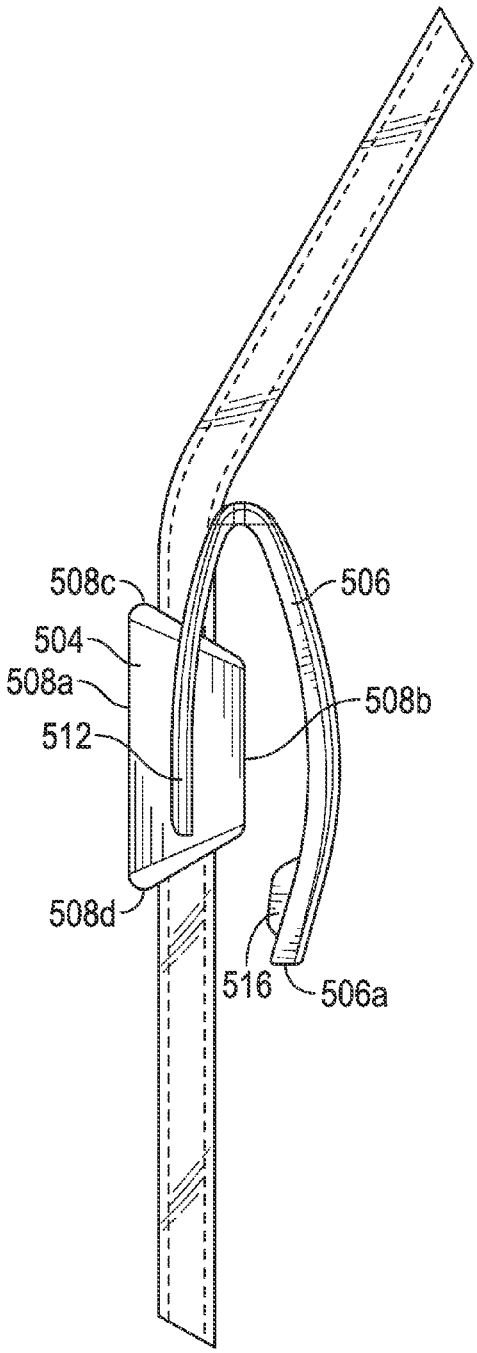
FIG. 6 illustrates a right side plan view of the drinking straw of FIG. 5.
Figure 7:
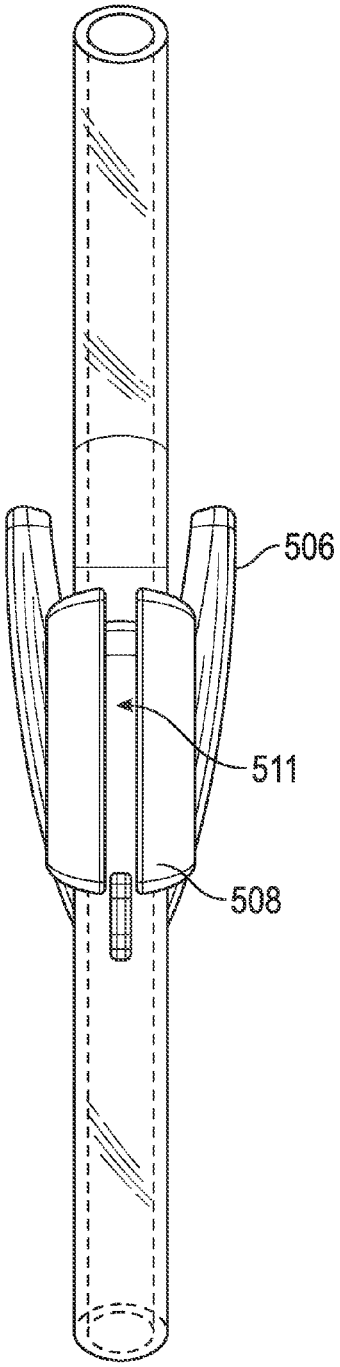
FIG. 7 illustrates a back plan view of the drinking straw of FIG. 5.

FIG. 5 illustrates a left side plan view of a drinking straw 500 having an attaching member according to one embodiment of the present invention. FIG. 6 illustrates a right side plan view of the drinking straw of FIG. 5. FIG. 7 illustrates a back plan view of the drinking straw of FIG. 5. The drinking straw 500 may include a generally elongated hollow tubular body 502 and an attaching member 504 designed to attach to the rim or edge of a glass or other container allowing the straw to be secured the glass or other container. The generally elongated tubular body 502 may comprise an upper portion 502*a*, having an upper open end for insertion into the mouth of a user to induce suction in the tubular body and a lower portion 502*b*, having a lower open end immersible in a liquid in a glass. The upper portion 502*a* may be integrally connected to the lower portion 502*b* via a center portion 502*T*center portion 502*c* may be curved for allowing the upper portion 502*a* to be angled slightly outward from the bottom portion 502*b* towards the user. In one embodiment, the center portion 502*c* may be a compressible and expandable section allowing the length of the elongated hollow tubular body 502 to be adjusted to the size of the glass and/or the volume or amount of wine within the glass. Additionally, the compressible and expandable center portion 502*c* may allow the user to adjust the angle of the upper portion 502*a* relative to the bottom portion 502

In one embodiment, the lower open end of the elongated hollow tubular body 502 may be cut at an angle 503. As a result of the angled lower open end 503, the lower open end may be in closer contact with the sidewall of the glass which in turn allows more liquid to be sucked into the elongated hollow tubular body 502. Additionally, the angled lower open end 503 may ensure that the wine suctioned through the elongated hollow tubular body 502 is from the top surface of the wine as the surface of the angled lower open end 503 is parallel to the top surface of the wine when the glass is tipped for drinking, as described below. The top surface of the wine is exposed to oxygen and has been aerated, as described below.

Additionally, the elongated hollow tubular body 502 may terminate above the wine in the glass or may be immersible within the top surface of the wine ensuring that the wine suctioned through the elongated hollow tubular body 502 is from the top surface of the wine where the wine has been exposed to oxygen and has been aerated. If the elongated hollow tubular body 502 terminates above the wine, the glass may be tipped causing the elongated hollow tubular body 502 to be immersed in the wine. Once the elongated hollow tubular body 502 is immersed in the wine, suction may be applied to the upper open end of the elongated hollow tubular body 502 causing the wine to be drawn into the elongated hollow tubular body 502 for consumption by a drinker.

As described above, when the straw 500 is secured to the rim of the glass, the lower open end of the lower portion 502*b* of the elongated hollow tubular body 502 may terminate above the top surface of the wine in the glass. (See FIG. 10A) The elongated hollow tubular body 502 may be generally positioned at a slight angle relative to the midpoint of the sidewall of the glass. To consume the wine, the drinker may tip the glass, so that the lower open end of the elongated hollow tubular member 502 is immersed within the top surface of the wine, and provide suction to the upper open end of the elongated hollow tubular member 502 causing the wine to be suctioned through the elongated hollow tubular body 502 and consumed by the drinker. (See FIG. 10B)

In accordance with one embodiment, the straw 500 may be rigid and shorter than a typical drinking straw and may be formed of plastic or any other material known in the art and the attaching member 504 may be formed of plastic, metal or any other material known in the art.

In accordance with the embodiment in FIGS. 5-7, the attaching member 504 may include a clip member 506 integrally connected to a hollow attachment member 508. The hollow attachment member 508 may be circular and have an inner diameter slightly larger than an outer diameter of the tubular body 502 allowing the hollow attachment member 508 to be slipped over and permanently or releasably affixed to the tubular body 502. As shown in FIGS. 5-7, the hollow attachment member 508 may include a back portion (or section) 508*a* and a front portion (or section) 508*b*, the back portion (or section) 508*a* having a longer vertical length than the front portion (or section) 508*b*. Furthermore, the hollow attachment member 508 may have an upper end portion 508*c* and a lower end portion 508*d* where the upper end portion 508*c* extends downwardly at an angle from the back portion (or section) 508*a* to the front portion (or section) 508*b* and the lower end portion 508*d* extend upwardly at an angle from the back portion (or section) 508*a* to the front portion (or section) 508*b*.

As shown in FIG. 7, the hollow attachment member 508 may include a slit or opening 511 extending vertically down the back portion 508*a*. The slit 511 may allow the diameter of the hollow attachment member 508 to adjust to the size of the elongated tubular member 502 of the straw 502. For example, for a straw having an elongated tubular member with a large diameter, the inner diameter of the hollow attachment member 508 can expand causing the size of the slit 511 to increase allowing for the large diameter of the elongated tubular member 502 of the straw 500.

When in use, the straw 500 may be placed in a glass such that the elongated hollow tubular body 502 extends downwardly into the glass and the clip member 506 of the attaching member 504 may be secured or clipped to the rim of the glass securing the straw 500 to the glass.

The clip member 506 may include an outer edge 507 extending upwardly and outwardly, in a vertical plane, from a bottom portion 506*a* of the clip member 506 towards a pair of top portions 506*b*, 506*c* of the clip member 506 forming a generally forming a generally V-shaped or U-shaped configuration. The pair of top portions 506*b*, 506*c* may be located on opposite sides of the elongated hollow tubular body 502 when the attaching member 504 is placed on the elongated hollow tubular body 502.

The clip member 506 may further include an inner edge 510 that extends downwardly and inwardly, in a vertical plane, from the pair of top portions 506*b*, 506*c* to a center 506*d* of the clip portion 506 forming a generally V-shaped or U-shaped configuration.

A pair of elongated members 512, 514 may be integrally connected to the pair of top portions 506*b*, 506*c*, respectively, and extend downwardly and outwardly, in a vertical plane, and be integrally connected to opposing sides of the hollow attachment member 508. According to one embodiment, the pair elongated members 512, 514 may have a curved configuration (See FIGS. 5-6)

According to one embodiment, the outer edge 507 may extend outwardly, in a horizontal plane, from the bottom 506*a* to a mid-point of the outer edge 507 and then may extend inwardly, in the horizontal plane, to the pair of top portions 506*b*, 506*c*. Similarly, the inner edge 510 may extend outwardly, in a horizontal plane, from the center 506*d* of the clip portion 506 to a mid-point of the inner edge 510 and then may extend inwardly, in the horizontal plane, to the pair of top portions 506*b*, 506*c*.

According to one embodiment, an inner surface of the clip member 506 may include a protrusion 516 for resting against the side of a glass when the straw 500 is secured to a glass.

Figure 8A:
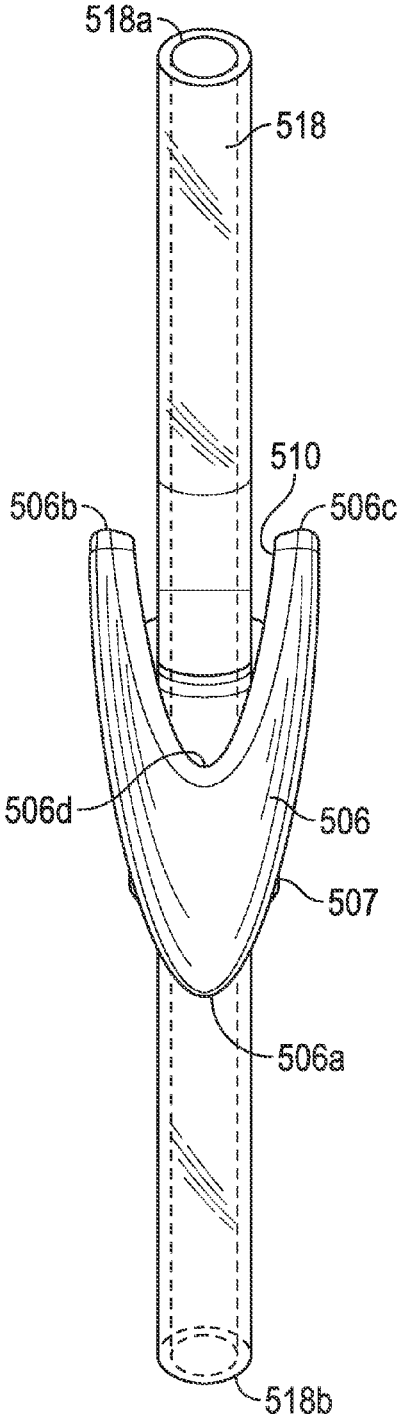
FIG. 8A illustrates a front plan view of a drinking straw having an attaching member according to one embodiment of the present invention.
Figure 8B:
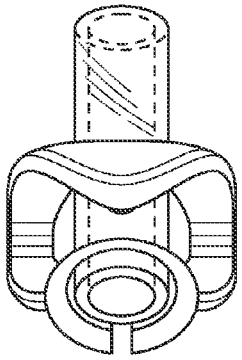
FIG. 8B illustrates a bottom perspective view of the drinking straw of FIG. 8A.
Figure 8C:
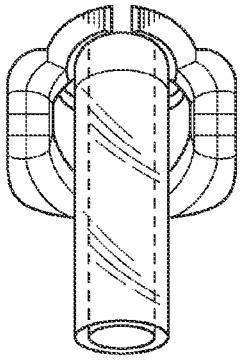
FIG. 8C illustrates a top plan view of the drinking straw of FIG. 8A.
Figure 9:
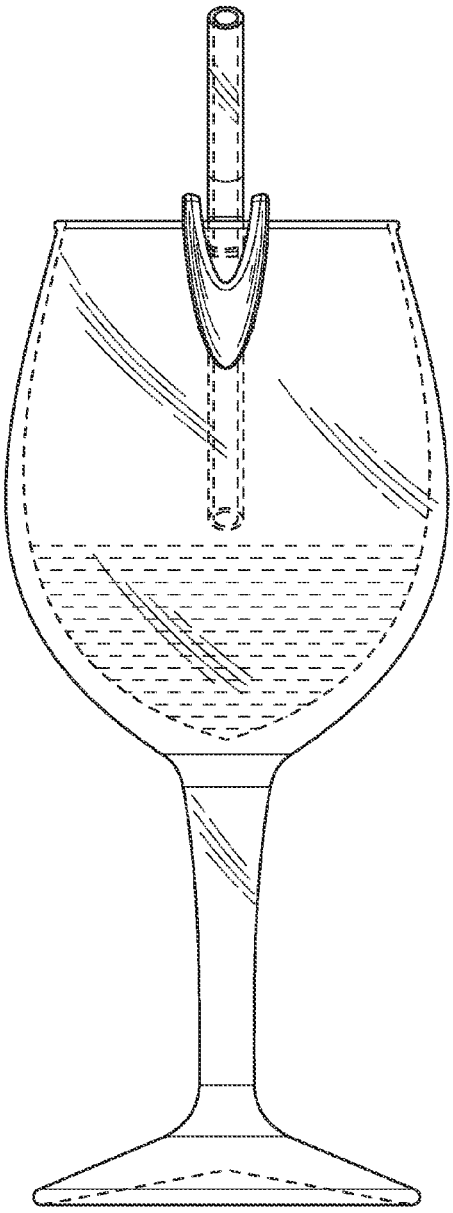
FIG. 9 illustrates the drinking straw of FIG. 8A secured to a glass, containing a liquid, located in an upright position.

FIG. 8A illustrates a front plan view of a drinking straw having an elongated hollow tubular body 518 with non-angled (i.e. straight) ends 518*a*, 518*b*. The hollow tubular body 518 may be inserted into or received with the attachment member 504 of FIGS. 5-7. FIG. 8B illustrates a bottom perspective view of the drinking straw of FIG. 8A. FIG. 8C illustrates a top plan view of the drinking straw of FIG. 8A. FIG. 9 illustrates the drinking straw of FIG. 8A secured to a glass, containing a liquid, located in an upright position.

Figure 10A:
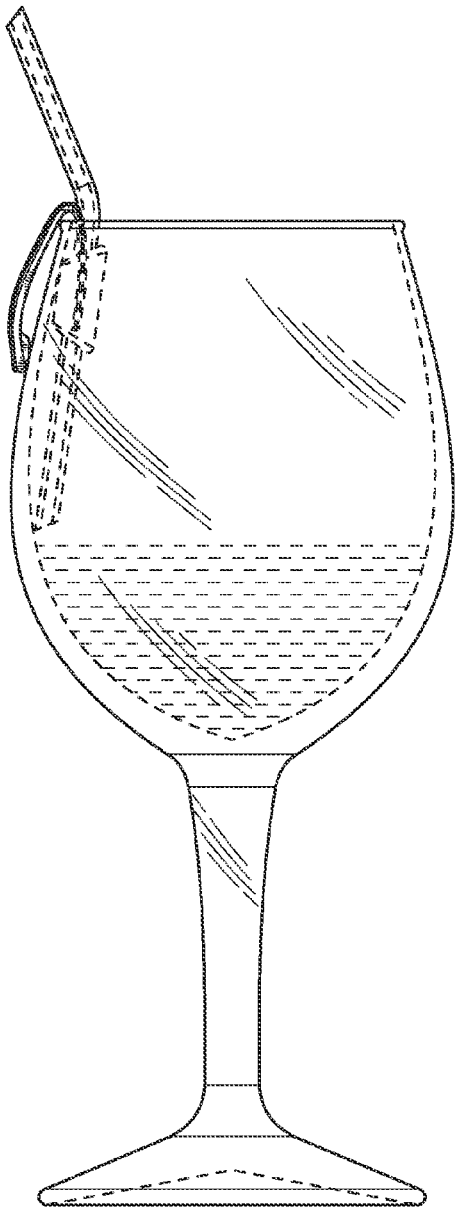
FIG. 10A illustrates the drinking straw of FIG. 6 secured to a glass, containing a liquid, located in an upright position.
Figure 10B:
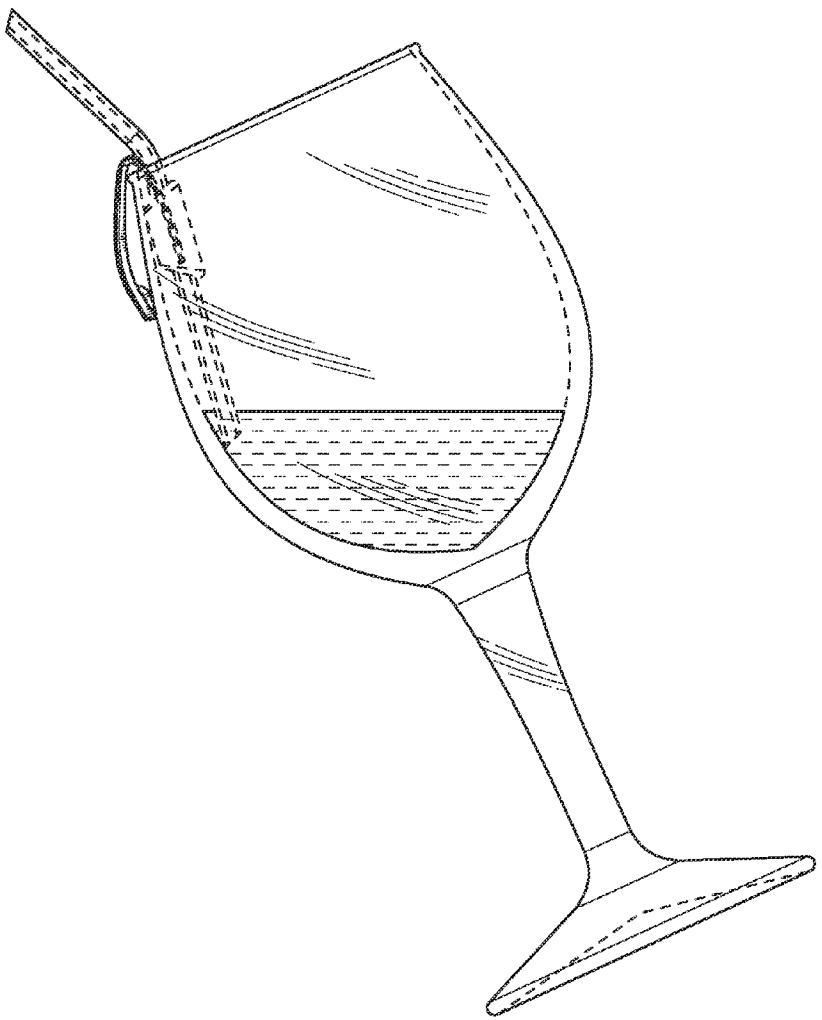
FIG. 10B illustrates the glass of FIG. 10A in a tipped position.

FIG. 10A illustrates the drinking straw of FIG. 6 secured to a glass, containing a liquid, located in an upright position. FIG. 10B illustrates the glass of FIG. 10A in a tipped position.

Figure 11:
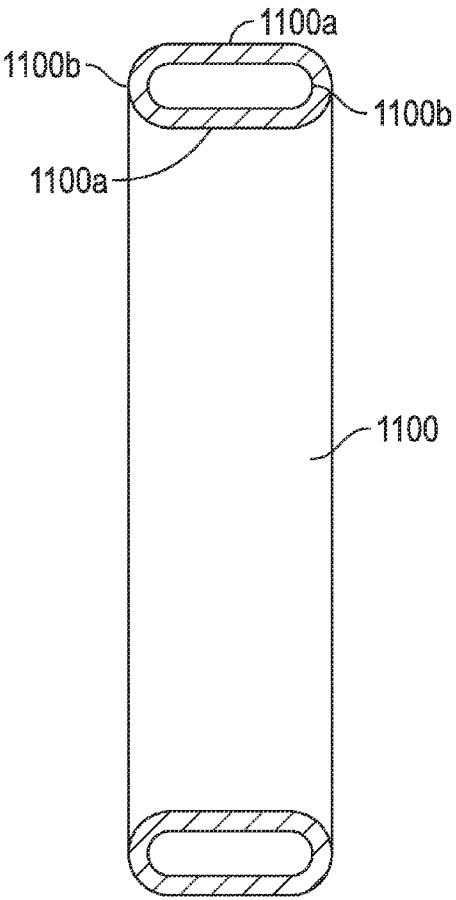
FIG. 11 illustrates a generally flat elongated hollow tubular body which may be used with an attachment member.

FIG. 11 illustrates a generally flat elongated hollow tubular body 1100 which may be used with the attachment members described above. The elongated body 1100 may be formed of two generally flat sides 1100*a*, spaced apart and parallel to each other, integrally connected to two curved ends 1100*b* forming the generally flat elongated hollow tubular body 1100. The flatness of the elongated hollow tubular body 1100 allows the wine to be more evenly dispersed over the tongue of the drinker.

One or more of the components and functions illustrated in FIGS. 1-11 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A drinking straw, comprising:

a generally elongated hollow tubular body, comprising:

an upper portion, having an upper open end for insertion into the mouth of a user to induce suction in the elongated hollow tubular body; and a lower portion integrally connected to the upper portion, the lower portion having a lower open end; and an attaching member secured to an outer surface of the elongated hollow tubular body, the attaching member comprising:

a clip member; and a hollow attachment member integrally connected to the clip member, the clip member comprising:

a front portion, comprising:

a pair of top portions;

a bottom portion;

an outer edge extending upwardly and outwardly, in a vertical plane, from the bottom portion towards the pair of top portions forming a generally V-shaped configuration, and where the outer edge extends outwardly, in a horizontal plane, from the bottom portion to a mid-point of the outer edge and then extends inwardly in the horizontal plane to the pair of top portions defining a curved configuration; and an inner edge extending downwardly and inwardly, in a vertical plane, from the pair of top portions to a clip center portion, the clip center portion located approximately half way down the clip member; and a back portion having a pair of elongated members integrally connected to the pair of top portions at a first end and the hollow attachment member at a second end.

2. The straw of claim 1, further comprising a center portion integrally connecting the upper portion to the lower portion, the center portion compressible and expandable for adjusting the length of the elongated hollow tubular body and for adjusting an angle of the upper portion relative to the lower portion.

3. The straw of claim 1, wherein the pair of elongated members are located on opposite sides of the elongated hollow tubular body.

4. The straw of claim 1, wherein the inner edge extends outwardly, in a horizontal plane, from the clip center portion to a mid-point of the inner edge and then extends inwardly, in the horizontal plane, to the pair of top portions defining a curved configuration.

5. The straw of claim 1, wherein hollow attachment member is circular and has an inner diameter slightly larger than an outer diameter of the elongated tubular body allowing the hollow attachment member to be slipped over the elongated tubular body.

6. The straw of claim 1, wherein the hollow attachment member comprises:

a back section having a back vertical length;

a front section having a front vertical length, the back vertical length longer than the front vertical length;

an upper end section extending downwardly from a top of the back section to a top of the front section; and a lower end section extending upwardly from a bottom of the back section to a bottom of the front section.

7. The straw of claim 6, wherein the back section of the hollow attachment member includes a slit extending the back vertical length.

8. The straw of claim 1, wherein the attaching member is for securing to a rim of a glass and extending the elongated hollow tubular body downwardly into the glass and wherein the lower open end of the elongated hollow tubular body terminates above a top surface of liquid within the glass.

9. The straw of claim 1, wherein the upper open end and the lower open end have an angled surface.

10. The straw of claim 1, wherein the upper open end and the lower open end have a flat surface.

11. A drinking straw, comprising:

a generally elongated hollow tubular body, comprising:

an upper portion, having an upper open end for insertion into the mouth of a user to induce suction in the elongated hollow tubular body; and a lower portion integrally connected to the upper portion, the lower portion having a lower open end; and an attaching member secured to an outer surface of the elongated hollow tubular body, the attaching member comprising:

a clip member, the clip member comprising:

a front portion, comprising:

a pair of top portions;

a bottom portion;

a hollow attachment member integrally connected to the clip member;

an outer edge extending upwardly and outwardly, in a vertical plane, from the bottom portion towards the pair of top portions forming a generally V-shaped configuration; and an inner edge extending downwardly and inwardly, in a vertical plane, from the pair of top portions to a clip center portion, the clip center portion located approximately half way down the clip member, and where the inner edge extends outwardly, in a horizontal plane, from the clip center portion to a mid-point of the inner edge and then extends inwardly, in the horizontal plane, to the pair of top portions defining a curved configuration; and a back portion having a pair of elongated members integrally connected to the pair of top portions at a first end and the hollow attachment member at a second end.

12. The straw of claim 11, wherein the hollow attachment member comprises:

a back section having a back vertical length;

a front section having a front vertical length, the back vertical length longer than the front vertical length;

an upper end section extending downwardly from a top of the back section to a top of the front section; and a lower end section extending upwardly from a bottom of the back section to a bottom of the front section.

13. A drinking straw, comprising:

a generally elongated hollow tubular body, comprising:

an upper portion, having an upper open end for insertion into the mouth of a user to induce suction in the elongated hollow tubular body; and a lower portion integrally connected to the upper portion, the lower portion having a lower open end; and an attaching member secured to an outer surface of the elongated hollow tubular body, the attaching member comprising:

a clip member; and a hollow attachment member integrally connected to the clip member, the clip member comprises:

a front portion, comprising:

a pair of top portions;

a bottom portion;

an outer edge extending upwardly and outwardly, in a vertical plane, from the bottom portion towards the pair of top portions forming a generally V-shaped configuration, and where the outer edge extends outwardly, in a horizontal plane, from the bottom portion to a mid-point of the outer edge and then extends inwardly in the horizontal plane to the pair of top portions defining a curved configuration; and an inner edge extending downwardly and inwardly, in a vertical plane, from the pair of top portions to a clip center portion, the clip center portion located approximately half way down the clip member, and where the inner edge extends outwardly, in a horizontal plane, from the clip center portion to a mid-point of the inner edge and then extends inwardly, in the horizontal plane, to the pair of top portions defining a curved configuration.

14. The straw of claim 13, wherein the hollow attachment member comprises:

a back section having a back vertical length;

a front section having a front vertical length, the back vertical length longer than the front vertical length;

an upper end section extending downwardly from a top of the back section to a top of the front section; and a lower end section extending upwardly from a bottom of the back section to a bottom of the front section.

* * * * *